US008534020B2

(12) United States Patent
Burrows et al.

(10) Patent No.: US 8,534,020 B2
(45) Date of Patent: Sep. 17, 2013

(54) CABINET DOOR PANEL LOCK

(75) Inventors: Sherman Burrows, Round Rock, TX (US); Heath Till, Taylor, TX (US)

(73) Assignee: Taylor Craft Cabinet Door L.P., Taylor, TX (US)

( * ) Notice: Subject to any disclaimer, the term of this patent is extended or adjusted under 35 U.S.C. 154(b) by 12 days.

(21) Appl. No.: 13/199,193

(22) Filed: Aug. 22, 2011

(65) Prior Publication Data

US 2013/0052388 A1 Feb. 28, 2013

(51) Int. Cl.
*E06B 3/70* (2006.01)

(52) U.S. Cl.
USPC ..... 52/455; 52/456; 52/778; 52/656.1

(58) Field of Classification Search
USPC ..... 52/127.6, 455, 456, 459, 475.1, 775, 52/778, 781.3, 763, 656.1, 656.2, 656.4, 52/766
See application file for complete search history.

(56) References Cited

U.S. PATENT DOCUMENTS

| | | | | | |
|---|---|---|---|---|---|
| 3,759,001 | A | * | 9/1973 | Judkins et al. | 52/241 |
| 4,478,002 | A | * | 10/1984 | English | 49/57 |
| 4,512,125 | A | * | 4/1985 | Eriksson et al. | 52/209 |
| 5,317,853 | A | * | 6/1994 | Lopes | 52/456 |
| 5,791,752 | A | * | 8/1998 | Hartman | 312/204 |

* cited by examiner

*Primary Examiner* — Jeanette E Chapman
*Assistant Examiner* — Daniel Kenny
(74) *Attorney, Agent, or Firm* — Davis Miles McGuire Gardner PLLC; Gregory S. Donahue

(57) ABSTRACT

The preferred embodiment utilizes a wood insert panel with notches at the top and center and at the bottom and center and a wood frame with protrusions that correspond with the notches and that are located in the center of the rails of the wood frame. The interlocking of the notches and protrusions permit for expansion of the wood insert panel within the grooves in the stiles of the wood frame while still centering and supporting the wood insert panel within the wood frame.

14 Claims, 5 Drawing Sheets

CABINET DOOR PANEL LOCK

CROSS REFERENCE TO RELATED APPLICATIONS

This non-provisional patent application does not claim priority to any United States provisional patent application or any foreign patent applications.

FIELD OF THE DISCLOSURE

The disclosures made herein relate generally to the wood door industry. The invention discussed herein is in the general classification of a wood door that permits for expansion of a wood insert panel within the grooves of the stiles of the wood door frame while still allowing for centering of the wood insert panel within the wood door frame.

BACKGROUND

This section introduces aspects that may be helpful in facilitating a better understanding of the invention. Accordingly, the statements of this section are to be read in this light and are not to be understood as admissions about what is in the prior art or what is not in the prior art.

Kitchen cabinets frequently have wood doors which are comprised of a wood frame and a wood insert panel that is dimensioned to have an appropriate thickness to be inserted into grooves around the perimeter of the interior of the wood frame (i.e. all four sides of the framing, including the top rail, bottom rail, left stile and right stile, have standard grooves in traditional cabinet doors). Interior and exterior doors, bathroom cabinets, garage doors, furniture and a variety of other items may also utilize wood frames and wood insert panels.

Traditionally, the wood insert panels are placed into the grooves of the wood frame such that the grain of the wood insert panels runs in an up and down (i.e. lengthwise) manner within the wood door frame. Wood expansion primarily occurs perpendicular to the grain due to the absorption of moisture in the wood insert panel. Hence, the wood insert panels tend to expand widthwise within the wood door frame when they are located in a humid environment. As a result of this expansion, wood insert panels located in humid environments have a tendency to press against the interior edge of the frame within the grooves of the stiles, resulting in cracking of the wood frames.

To solve this problem, door insert spacers are often inserted into the grooves of the wood frames. These insert spacers allow the insert panel to be spaced away from the interior edges of the frame within the groove. The insert panel makes contact with the insert spacers rather than the edge of the frame within the groove. The insert spacers will compress and allow a limited amount of expansion of the wood insert panels within the grooves of the wood frames as moisture accumulates within the wood insert panels. These insert spacers may consist of a variety of materials and have a myriad of shapes.

The spacers are designed to be of appropriate dimension and strength to be inserted into the groove of the frame while still making sufficient contact with the insert panel to center the insert panel and prevent shifting of the insert panel within the frame. However, the insert spacers are also designed to allow for compression of the spacers when necessary to accommodate expansion of the insert panel when moisture accumulates within the insert panel.

Insert spacers have certain limitations because they need to be of sufficient size to allow for expansion of the insert panel within the groove to prevent cracking of the frame, but the spacers cannot be designed to be too thick as they also must serve the purpose of centering the insert panel in the frame to prevent rattling and shifting of the insert panel within the frame. Often the insert spacers simply cannot be adequately sized to perform both the functions of supporting and centering the insert panel and creating a sufficient gap between the insert panel and the frame to permit for the expansion of the insert panel within the frame in particularly humid environments.

There is a need in the art for an easy to use, aesthetically pleasing, durable and inexpensive wood door that allows for expansion of a wood insert panel within grooves in the stiles of a wood frame while also allowing the wood insert panel to be appropriately centered and supported in the wood frame.

SUMMARY OF THE DISCLOSURE

The preferred embodiment utilizes a wood insert panel with notches and a wood frame with protrusions that correspond with the notches that emanate from the top rail and bottom rail of the wood frame. This design permits expansion of the wood insert panel within the grooves in the stiles of the wood frame while still centering and supporting the wood insert panel within the wood frame.

In the preferred embodiment, the protrusions are at the top and center and bottom and center of the wood frame and are crescent shaped or semi-circular. The notches in the wood insert panel are also crescent shaped or semi-circular to accommodate the protrusions from the frame and are located at the top and center and bottom and center of the insert panel to lock the insert panel in place within the frame and keep the insert panel from shifting from side-to-side within the frame.

Certain alternative embodiments may utilize a variety of other designs for the protrusions of the frame and the notches in the wood insert panel. For example, a simple dowel could emanate from the top and bottom rails of the frame and be inserted into a corresponding rectangular notch cut into the insert panel. The arrangement of protrusion and notch merely needs to serve the purpose of locking the insert panel in place within the frame. Therefore, the precise shape and location of these interlocking parts is not absolutely critical. In fact, in certain embodiments, the protrusion may be located on the insert panel and the corresponding notch may be located on the top or bottom rails of the frame or within a groove in the top or bottom rails of the frame.

Under some applications embodiments of the invention may provide a cabinet door or the like having a frame with protrusions emanating from the top and bottom rails of the frame to interlock with notches in an insert panel to prevent shifting of the insert panel within the frame.

Under some applications embodiments of the invention may provide a cabinet door or the like having a frame with protrusions emanating from the top and bottom rails of the frame to interlock with notches in an insert panel to center the insert panel within the frame.

Under some applications embodiments of the invention may provide a cabinet door or the like having a frame with protrusions emanating from the top and bottom rails of the frame to interlock with notches in an insert panel to prevent rattling of the insert panel within the frame.

Under some applications embodiments of the invention may provide a cabinet door or the like having a frame with protrusions emanating from the top and bottom rails of the frame to interlock with notches in an insert panel to prevent the insert panel from falling out of the frame.

Under some applications embodiments of the invention may provide a cabinet door or the like having a frame with protrusions emanating from the top and bottom rails of the frame to interlock with notches in an insert panel to allow the insert panel to be sufficiently spaced from the interior edge of the grooves in the stiles of the frame to allow for expansion of the insert panel within the grooves in the stiles of the frame in humid environments.

Under some applications embodiments of the invention may provide a cabinet door or the like having a frame with protrusions emanating from the top and bottom rails of the frame to interlock with notches in an insert panel to allow the insert panel to be sufficiently spaced from the interior edge of the grooves in the stiles of the frame to prevent cracking of the frame when the insert panel expands in humid environments.

Under some applications, embodiments of the invention may provide a relatively easy to use cabinet door or the like having a frame with protrusions emanating from the top and bottom rails of the frame to interlock with notches in an insert panel to prevent shifting of the insert panel within the frame.

Under some applications, embodiments of the invention may provide a reliable to use cabinet door or the like having a frame with protrusions emanating from the top and bottom rails of the frame to interlock with notches in an insert panel to prevent shifting of the insert panel within the frame.

Under some applications, embodiments of the invention may provide an inexpensive to manufacture cabinet door or the like having a frame with protrusions emanating from the top and bottom rails of the frame to interlock with notches in an insert panel to prevent shifting of the insert panel within the frame.

Under some applications, embodiments of the invention may provide a durable cabinet door or the like having a frame with protrusions emanating from the top and bottom rails of the frame to interlock with notches in an insert panel to prevent shifting of the insert panel within the frame.

Under some applications, embodiments of the invention may provide a strong cabinet door or the like having a frame with protrusions emanating from the top and bottom rails of the frame to interlock with notches in an insert panel to prevent shifting of the insert panel within the frame.

Under some applications, embodiments of the invention may provide a cabinet door or the like having a frame with protrusions emanating from the top and bottom rails of the frame to interlock with notches in an insert panel to prevent shifting of the insert panel within the frame that is aesthetically pleasing and suitable for high end cabinet applications.

BRIEF DESCRIPTION OF THE DRAWINGS

Some embodiments of apparatus and/or methods of the present invention are now described, by way of example only, and with reference to the accompanying drawings, in which.

DETAILED DESCRIPTION OF THE DRAWINGS

Figure 1:
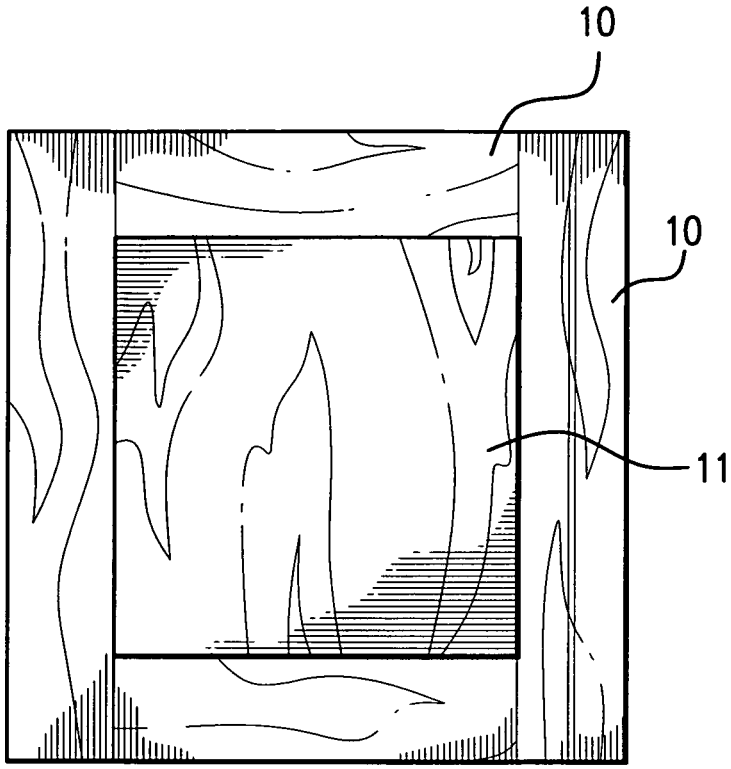
FIG. 1 depicts a frontal view of a traditional wood door having a wood insert panel within a wood frame.

FIG. 1 depicts a frontal view of a traditional wood door having a wood insert panel within a wood frame.

The wood door has a frame 10 that surrounds a wood insert panel 11. The frame 10 surrounds the wood insert panel 11 on all sides (i.e. the frame consists of a top rail, a bottom rail, a right stile and a left stile). The wood insert panel 11 and the frame 10 are both substantially rectangular in shape. The wood insert panel 11 is designed to be of such a dimension around the perimeter to securely fit within a groove (not pictured) that runs along the entire inside perimeter of the frame 10 (i.e. a groove is present on the interior of all four sides of the frame 10 to accept the insert panel 11).

Figure 2:
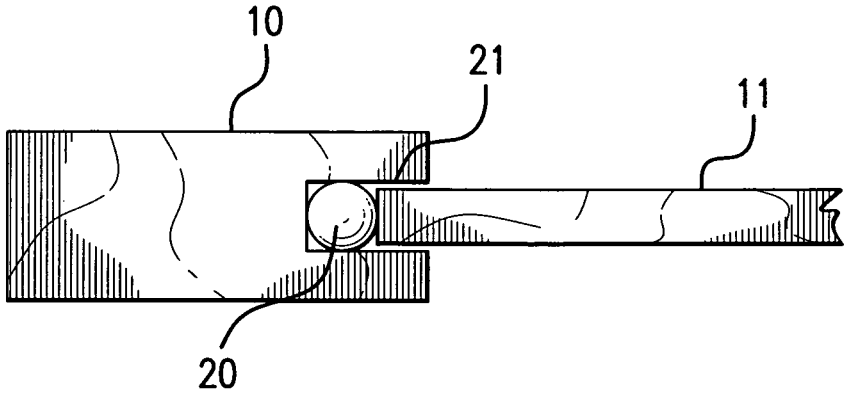
FIG. 2 depicts a cross-sectional view of a conventional door frame and insert panel with an insert panel spacer placed in a groove of the door frame.

FIG. 2 depicts a cross-sectional view of a conventional door frame and insert panel with an insert panel spacer placed in a groove of the door frame.

The frame 10 has a groove 21 that runs along the entire inside perimeter of the frame 10. The groove 21 is dimensioned to be of appropriate width to accommodate the thickness of the outside perimeter of the insert panel 11.

The groove 21 also is capable of receiving insert spacers such as insert spacer 20. The insert spacers may be placed at uniform distances from one another in the groove around the entire inside perimeter of the frame 10. Alternatively, the insert spacers may run continuously in the grooves around the entire inside perimeter of the frame. The insert spacers are designed to center and secure the insert panel 11 in the frame 10 while also providing a compression zone to allow for expansion of the insert panel 11 within the groove 21 of the frame 10.

The insert spacers may be made of a variety of materials, including hollow tubing formed from compressible materials such as PVC or silicone. The insert spacers may also be spherical ("spacer ball") and made of rubber or foam. The insert spacer 20 shown in FIG. 2 is spherical in design and is one of the most widely used types of insert spacers. However, because the insert spacer 20 is spherical, it has a depth that is the same as its width. As a result, a wide range of insert panel swelling cannot be accommodated. The width of the insert spacer 20 corresponds with the thickness of the outside perimeter of the insert panel 11 and the depth of the insert spacer 20 (i.e. the compression zone provided by the insert spacer 20) is equivalent to the insert spacer width. This same problem persists even when the insert spacers are cylindrical tubing which is also common in the industry. Moreover, both cylindrical insert spacers and spherical insert spacers are susceptible to falling out of the groove 21 of the frame 10 and not being able to serve their intended purpose of securing and centering the insert panel 11 while also allowing the insert panel 11 to swell with moisture in humid environments to compress the insert spacer 20 without destroying the frame 10.

Figure 3:
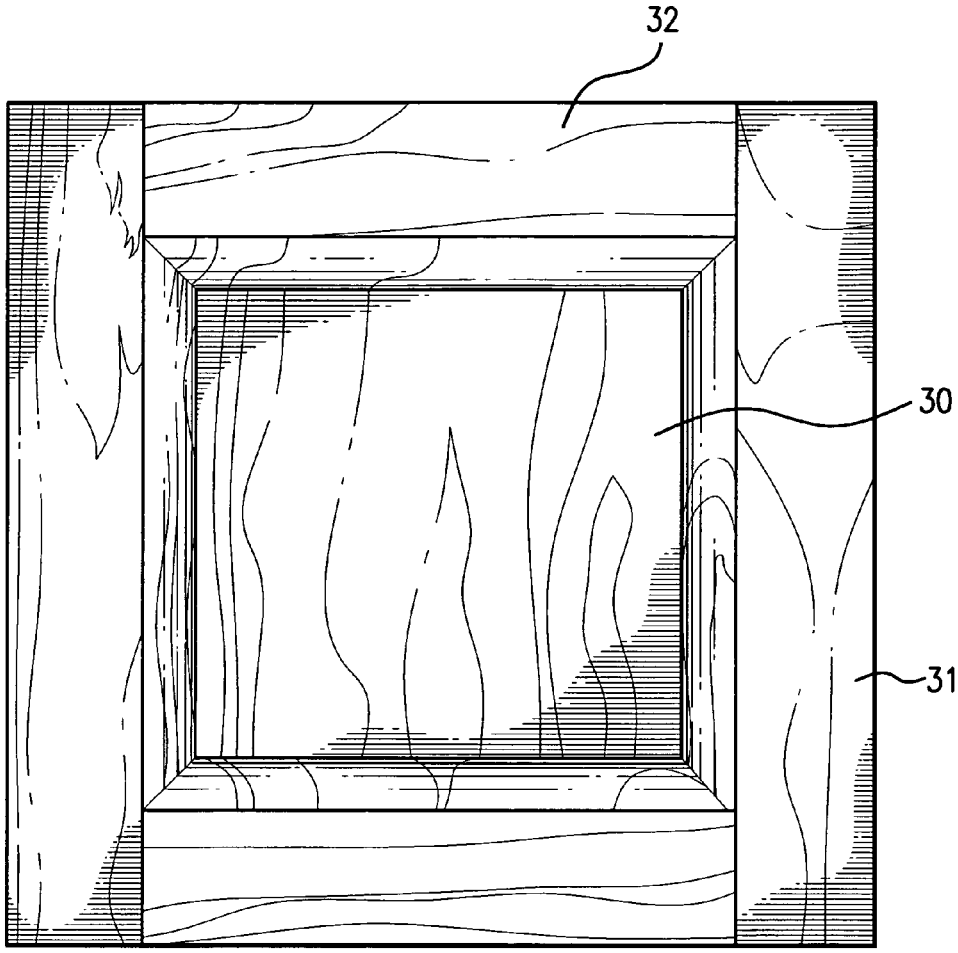
FIG. 3 depicts a frontal view of the preferred embodiment of the insert panel as it is situated within a cabinet door frame.

FIG. 3 depicts a frontal view of the preferred embodiment of the insert panel as it is situated within a cabinet door frame. In this preferred embodiment, the frame is comprised of stiles 31 on each side of the insert panel 30 and top and bottom rails 32 on the top and bottom of the insert panel 30. The insert panel 30 is placed within a groove contained in the stiles 31, and the insert panel 30 has notches (not visible in FIG. 3 because the outer portion of the top and bottom rails conceals the notches) at the top and bottom to interlock with protrusions (not visible in FIG. 3 because the outer portion of the top and bottom rails conceals the protrusions) from the top and bottom rails 32.

In this preferred embodiment, the insert panel 30 has the grain of the wood running lengthwise in an up and down manner that would traditionally be perpendicular to the floor when the insert panel 30 is positioned in the frame and the cabinet door is installed.

Figure 4:
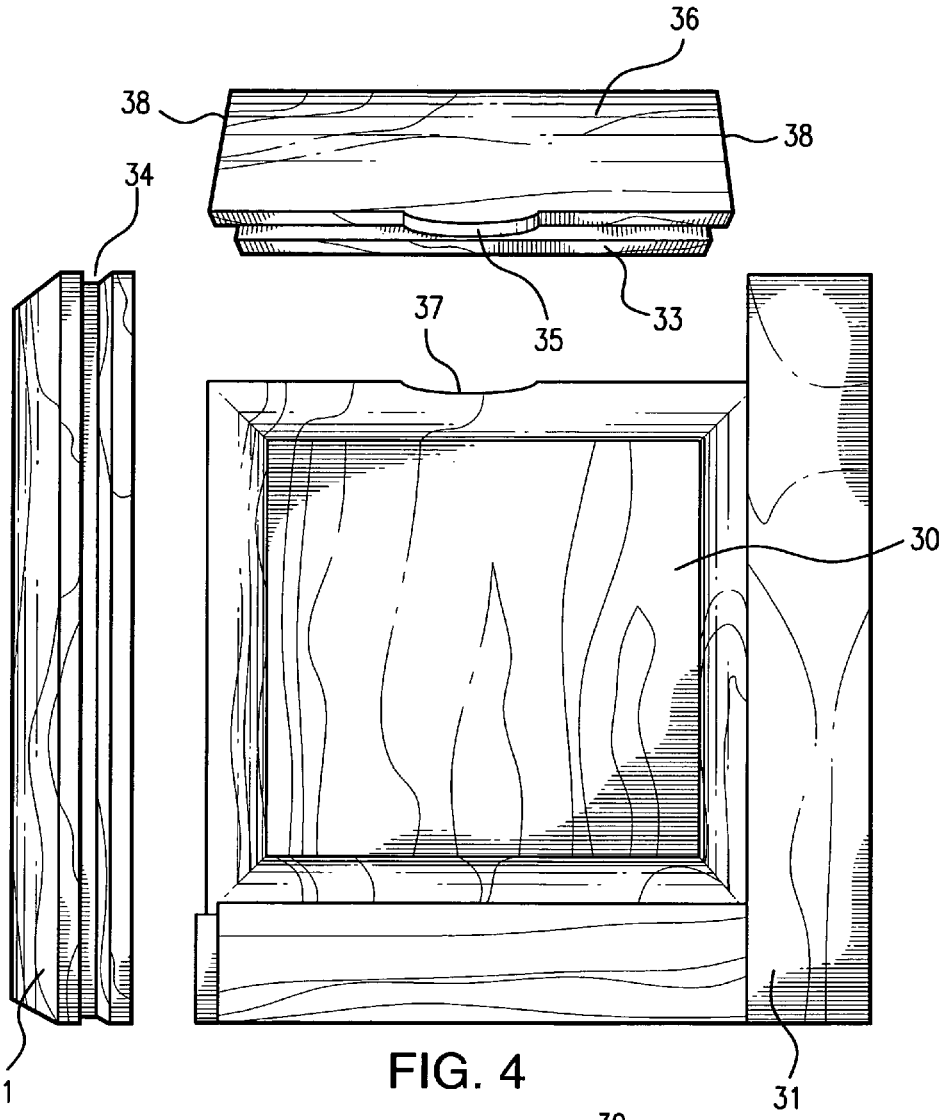
FIG. 4 depicts a frontal view of the preferred embodiment of the cabinet door with the left stile removed and rotated and the top rail removed from the insert panel and shown in cross-section.
Figure 4A:
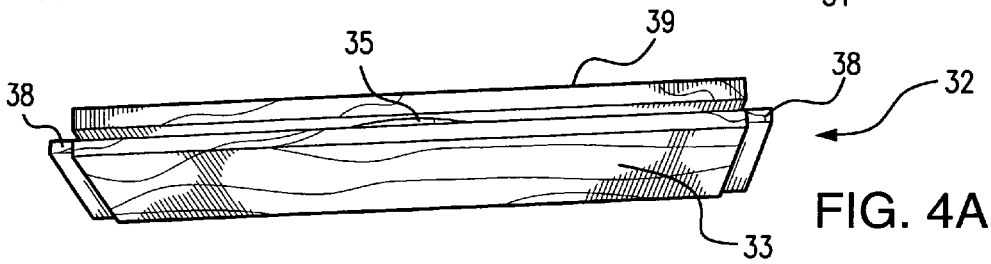
FIG. 4A depicts a perspective view of the top rail of the preferred embodiment of the cabinet door.

FIG. 4 depicts a frontal view of the preferred embodiment of the cabinet door with the left stile removed and rotated to reveal the groove and the top rail removed from the insert panel and shown in cross-section (with the outer portion 39 of the top rail which is shown in FIG. 4A removed). The left stile 31 is rotated from its initial orientation in FIG. 3 to permit the groove 34 of the left stile 31 to be visible. The groove 34 is dimensioned to accept the edge of the insert panel 30. The left stile 31 has a groove 34 cut between an outer portion of the stile 31, which is visible in both FIG. 3 and FIG. 4, and an inner portion of the stile which is not visible in FIG. 3 but can be seen in FIG. 4. The central portion of the left stile 31 is located under the groove 34 between the outer portion of the stile 31 and the inner portion of the stile 31. As would be obvious to one skilled in the art, the right stile 31 has a similar structure to the left stile 31.

The top rail is also rotated from its orientation as shown in FIG. 3 and has the outer portion of the top rail which is shown in FIG. 3 removed to reveal the protrusion 35 located on the central portion 36 of the top rail. The top rail has a semi-circular protrusion 35 that fits into a semi-circular notch 37 cut into the top of the insert panel 30. In this preferred embodiment, the protrusion 35 is located in the central portion 36 of the top rail and the central portion 36 has ends (tenons) 38 dimensioned to also fit into the groove 34 of the stiles 31. The ends 38 located on the central portion 36 of the top rail permit a classic mortise and tenon fit of the top rail into grooves (mortise) of the stiles 31. Although not visible in FIG. 4, another semi-circular notch is cut into the bottom of the insert panel for insertion of another semi-circular protrusion in the bottom rail. As one skilled in the art would readily recognize, the bottom rail has a similar structure to the top rail.

The top and bottom rails of the preferred embodiment have a central portion 36 which is not visible from the front (as shown in FIG. 3) when the cabinet door is assembled (i.e. when the frame surrounds the insert panel on all sides). The central portion 36 is located between the inner portion 33 and the outer portion of the top and bottom rails. The outer portion of the top rail which has been removed in FIG. 4 conceals the notch 37 of the insert panel 30 and the protrusion 35 of the central portion 36 of the top and bottom rails to provide a more aesthetically pleasing design when the door is installed. The inner portion 33 of the top rail is, however, visible in the cross-section shown in FIG. 4.

It should be understood that in the preferred embodiment, the central portion 36, inner portion and outer portion of the rails actually create a single piece wherein the central portion 36 is merely the portion of the top and bottom rails located between the inner and outer portions of the rails and the central portion 36 has the protrusion 35 in its center and ends (tenons) 38 for creating the frame through insertion of the ends 38 into the grooves 34 of the stiles 31.

The interlocking of the notches 37 of the insert panel 30 and the protrusions 35 from the top and bottom rails allow the insert panel 30 to be appropriately spaced from the interior edge of the stiles 31 to allow for expansion of the wood insert panel 30 within the grooves 34 in the stiles 31 without damaging the wood frame. The wood insert panel 30 can be placed in the grooves 34 of the frame at such a distance from the interior edges of the stiles 31 that even extreme swelling of the insert panel 30 in humid conditions can be accommodated without the insert panel 30 coming into contact with the interior edges of the grooves 34 in the stiles 31.

In addition, the existence of the interlocking notches 37 of the insert panel and the protrusions 35 of the rails allows for centering of the wood insert panel 30 within the wood frame even in arid conditions when the wood insert panel 30 loses moisture and shrinks widthwise perpendicular to the grain. In dry conditions, without the use of the interlocking notches 37 of the insert panel 30 and the protrusions 35 of the rails, the wood insert panel 30 would ordinarily be free to shift side to side within the grooves 34 of the stiles 31 which could result in the wood insert panel 30 becoming off-center, rattling or even falling out of the grooves 34 of the stiles 31.

FIG. 4A depicts a perspective view of the top rail of the preferred embodiment of the cabinet door. In this view, all three portions of the top rail 32 are visible. The outer portion 39 and the inner portion 33 surround the central portion having protrusion 35 and ends 38.

Certain alternative embodiments may utilize a variety of other designs for the protrusions from the top and bottom rails of the frame and the notches in the wood insert panel. The arrangement of protrusions and notches merely needs to serve the purpose of locking the insert panel in place within the frame. Therefore, the precise shape and location of these interlocking parts is not absolutely critical. For example, a rectangular shaped notch and a dowel shaped or other rectangular or cylindrical shaped protrusion could also be utilized. The crescent shaped design of the protrusions and notches is preferred simply because it distributes the stresses on the insert panel when the insert panel attempts to shift within the frame which helps avoid splintering of the insert panel and damage to the frame.

In certain other alternative embodiments, the protrusions are located on the insert panel while the notches are located within the grooves of the rails of the frame. In this alternative embodiment, the notches located within the grooves of the frame can be crescent shaped/semi-circular and the protrusions on the wood insert panel can also be crescent shaped/semi-circular. The notches are dimensioned to accommodate the protrusions. In this alternative embodiment, the protrusions emanating from the wood insert panel are located at the top and center and bottom and center of the wood insert panel and the corresponding notches are located at the top and center and bottom and center of the rails within the grooves of the frame such that the notches extend slightly deeper than the groove within the top and bottom rails.

Figure 5:
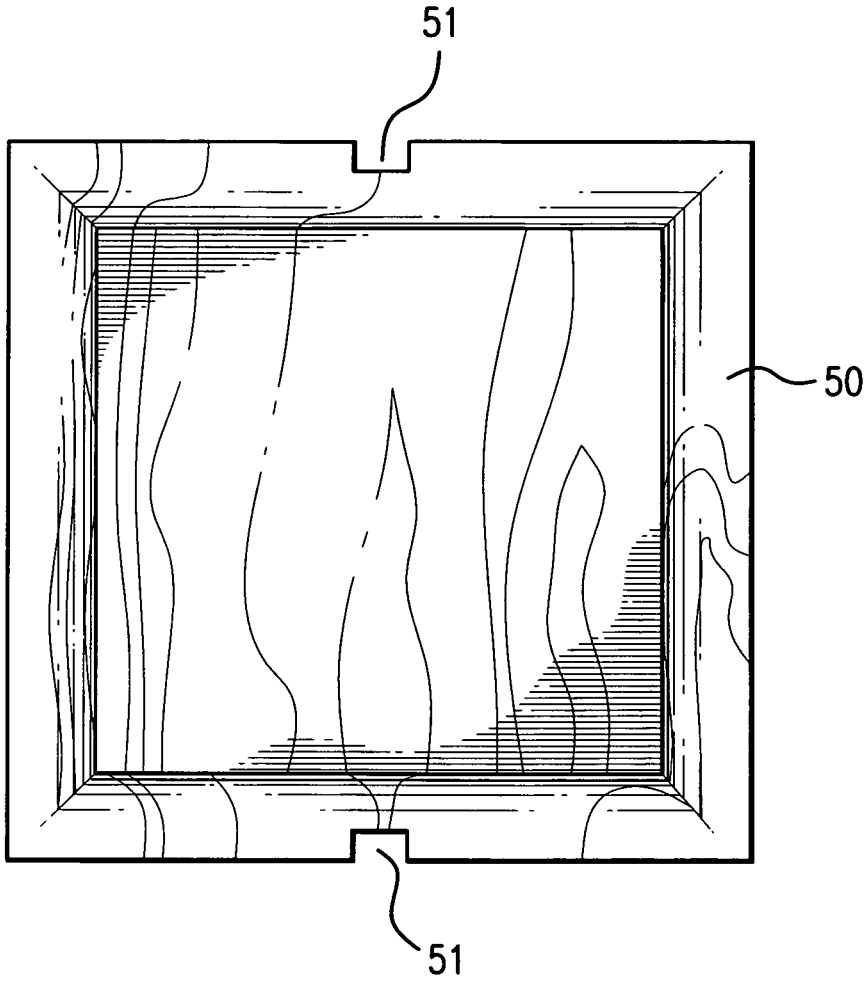
FIG. 5 depicts a frontal view of an alternative embodiment of the insert panel.

FIG. 5 depicts a frontal view of an alternative embodiment of the insert panel. In this alternative embodiment, rectangular shaped notches 51 are cut into the top and center and the bottom and center of the wood insert panel 50. These notches 51 are shaped to accommodate a dowel or other rectangular or cylindrical shaped protrusion emanating from the top rail and bottom rail of a wood cabinet door frame.

Figure 6:
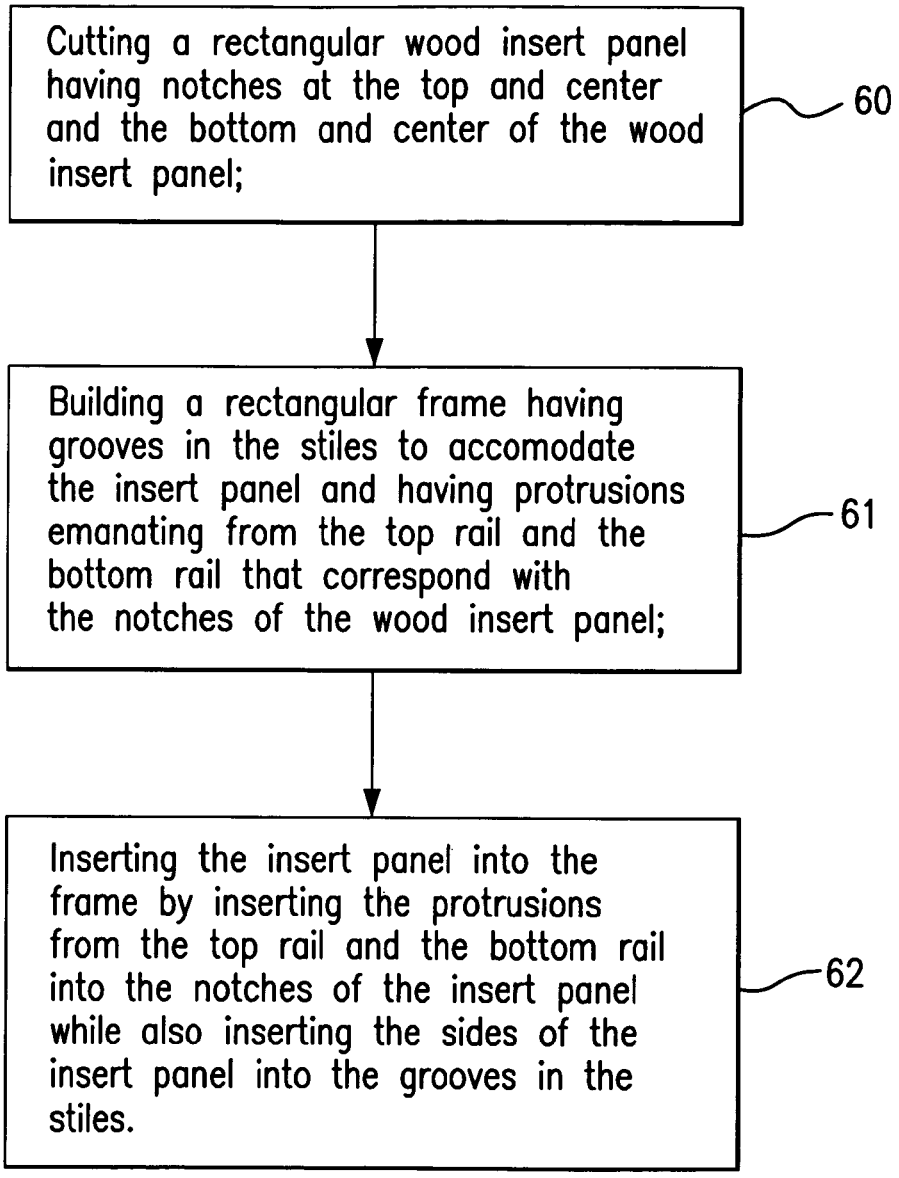
FIG. 6 depicts the method of manufacture for the preferred embodiment of the cabinet door.

FIG. 6 depicts the method of manufacture for the preferred embodiment of the cabinet door. The method comprises the steps of: cutting a rectangular wood insert panel having notches at the top and center and the bottom and center of the wood insert panel 60; building a rectangular frame having grooves in the stiles to accommodate the insert panel and having protrusions emanating from the top rail and the bottom rail that correspond with the notches of the wood insert panel 61; and inserting the insert panel into the frame by inserting the protrusions from the top rail and the bottom rail into the notches of the insert panel while also inserting the sides of the insert panel into the grooves in the stiles 62.

A person of skill in the art would readily recognize that the order of the steps of the various above-described methods is not necessarily critical. A person of skill in the art would also recognize that the methodology of FIG. 6 could be slightly modified to produce the method of manufacture of a cabinet door or the like in which the protrusions are located on the insert panel and the notches are located in the top and bottom rails or within the grooves of the top and bottom rails. Such a method could involve the steps of: cutting a rectangular wood insert panel having protrusions at the top and center and the bottom and center of the wood insert panel; building a rectangular frame having grooves in the stiles to accommodate the insert panel and having notches in the grooves of the top rail and the bottom rail that correspond with the protrusions of the wood insert panel; and inserting the insert panel into the frame by inserting the protrusions from the insert panel into the notches of the top rail and bottom rail while also inserting the sides of the insert panel into the grooves in the stiles.

It will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as set forth in the claims.

What is claimed is:

1. A door comprising:

(a) a wood insert panel with a first notch and a second notch; and (b) a frame having grooves in a pair of stiles for accepting the wood insert panel wherein there is a first protrusion emanating from a top rail of the frame and located in the center of the top rail and there is a second protrusion emanating from a bottom rail of the frame and located in the center of the bottom rail and wherein the first notch is located at the top of the wood insert panel and is located in the center of the wood insert panel and accepts the first protrusion and the second notch is located in the bottom of the wood insert panel and is located in the center of the insert panel and accepts the second protrusion.

2. The door of claim 1 wherein the first notch and the second notch and the first protrusion and the second protrusion are crescent shaped.

3. The door of claim 1 wherein the first notch and the second notch are rectangularly shaped and the first protrusion and the second protrusion are shaped like a dowel for insertion into the first notch and the second notch.

4. The door of claim 1 wherein the first protrusion is located in the center of a central portion of the top rail surrounded by an inner portion and an outer portion of the top rail and the second protrusion is located in the center of a central portion of the bottom rail surrounded by an inner portion and an outer portion of the bottom rail.

5. The door of claim 1 wherein the wood insert panel is inserted into the grooves of the pair of stiles such that the grain of the wood runs lengthwise in an up and down manner.

6. A method of manufacturing a door comprising the steps of:

(a) cutting a rectangular wood insert panel having at least one notch in the wood insert panel;

(b) building a rectangular frame having grooves in a pair of stiles to accommodate the insert panel wherein the rectangular frame also has at least one protrusion emanating from at least one of a top rail and a bottom rail of the frame wherein the at least one protrusion is insertable into the at least one notch of the wood insert panel; and (c) centering the insert panel in the grooves of the pair of stiles by inserting the at least one protrusion from the at least one of the top rail and the bottom rail into the at least one notch of the insert panel.

7. The method of manufacturing a door of claim 6 wherein the at least one notch and the at least one protrusion are crescent shaped.

8. The method of manufacturing a door of claim 6 wherein the at least one notch is rectangularly shaped and the at least one protrusion is shaped like a dowel for insertion into the rectangularly shaped notch.

9. The method of manufacturing a door of claim 6 wherein there is a first protrusion emanating from the top rail and a second protrusion emanating from the bottom rail of the frame and there is a first notch at the top of the insert panel to accept the first protrusion and there is a second notch in the bottom of the wood insert panel to accept the second protrusion.

10. The method of manufacturing a door of claim 9 wherein the first protrusion is located in the center of the top rail and the second protrusion is located in the center of the bottom rail and the first notch is located in the center of the insert panel and the second notch is located in the center of the insert panel.

11. A door comprising:

(a) a wood insert panel with a first protrusion and a second protrusion; and (b) a frame having grooves in a pair of stiles for accepting the wood insert panel wherein the first protrusion is located in the center of the insert panel and emanates from the top of the insert panel and the second protrusion is located in the center of the insert panel and emanates from the bottom of the insert panel and wherein there is a first notch located in the center of a top rail within grooves of the top rail to accept the first protrusion and there is a second notch located in the center of a bottom rail within grooves of the bottom rail to accept the second protrusion.

12. The door of claim 11 wherein the first notch and the second notch and the first protrusion and the second protrusion are crescent shaped.

13. The door of claim 11 wherein the frame is wood.

14. The door of claim 11 wherein the wood insert panel is inserted into the grooves in the pair of stiles such that the grain of the wood runs lengthwise in an up and down manner.

* * * * *